US006018284A

United States Patent [19]

Rival et al.

[11] Patent Number: 6,018,284

[45] Date of Patent: Jan. 25, 2000

[54] CIRCUIT BREAKER WITH HIGH ELECTRODYNAMIC STRENGTH AND BREAKING CAPACITY

[75] Inventors: Marc Rival, Panissage; Marc Blancfene, Domessin; Claude Grelier, Crolles, all of France

[73] Assignee: Schneider Electric Industries SA, France

[21] Appl. No.: 09/353,766

[22] Filed: Jul. 15, 1999

[30] Foreign Application Priority Data

Jul. 29, 1998 [FR] France ..... 98 09938

[51] Int. Cl.[7] ..... H01H 75/00

[52] U.S. Cl. ..... 335/16; 335/6; 218/22; 218/154

[58] Field of Search ..... 335/6, 15, 16, 335/147, 195, 202, 201; 218/22, 154; 200/401

[56] References Cited

U.S. PATENT DOCUMENTS

| | | | |
|---|---|---|---|
| 4,816,792 | 3/1989 | Belbel et al. | 335/6 |
| 5,519,180 | 5/1996 | Zaffetti et al. | 200/401 |
| 5,694,098 | 12/1997 | Mody et al. | 335/16 |
| 5,731,560 | 3/1998 | Nebon et al. | 218/22 |
| 5,793,270 | 8/1998 | Beck et al. | 218/154 |

FOREIGN PATENT DOCUMENTS 0 222 645 5/1987 European Pat. Off. .

0 789 380 8/1997 European Pat. Off. .

*Primary Examiner*—Lincoln Donovan
*Assistant Examiner*—Tuyen T. Nguyen
*Attorney, Agent, or Firm*—Parkhurst & Wendel, L.L.P.

[57] ABSTRACT

The circuit breaker pole or poles comprise a movable contact means with a support carrier movable with respect to the frame between an open position and a closed position and one or more contact fingers movable with respect to the support carrier between a contact position and a retracted position. Electromagnetic compensation means are designed to apply electromagnetic forces on the contact finger or fingers tending to keep the contact finger or fingers in contact with the stationary contact means. Electromagnetic limiting means are designed to apply electromagnetic forces on the contact finger or fingers tending to drive the finger or fingers to their retracted position. The electromagnetic compensation means and the electromagnetic limiting means are such that when the current intensity flowing in the movable contact means is under a threshold called the limiting threshold, the finger or fingers are kept in contact with the stationary contact means, and that above said threshold, the finger or fingers are driven to their retracted position. The resultant of the forces applied by the carrier on the kinematic connecting means when the current intensity flowing in the movable contact means reaches the limiting threshold is under the ultrafast opening threshold.

5 Claims, 8 Drawing Sheets

CIRCUIT BREAKER WITH HIGH ELECTRODYNAMIC STRENGTH AND BREAKING CAPACITY

BACKGROUND OF THE INVENTION

The invention relates to an operating mechanism of a low voltage multipole circuit breaker with high electrodynamic strength and comprising an electrical power circuit having, per pole, a pair of compensated contact means held in the closed position by electrodynamic compensation effect of the repulsion forces.

A mechanism of the kind mentioned is described in the document EP-A-222,645 filed by the applicant and comprises a toggle device associated to a tripping hook and to an opening spring to drive the movable contact to an open position when the hook is actuated from a loaded position to a tripped position, a switching bar made of insulating material coupled to the toggle device extending transversely to the frame and comprising a rotary shaft supporting the movable contact means of all the poles, an opening ratchet operating in conjunction with the tripping hook to perform loading or tripping of the mechanism, respectively in the locked position or in the unlocked position of said ratchet, and a latching lock operated by a tripping part to actuate the opening ratchet to the unlocked position. The electrodynamic strength of the circuit breaker results from the action of the contact pressure springs on the multiple fingers, and of the compensated contact means, whose articulation axis is subjected to strong mechanical reactions. The mechanism is able to absorb these reactions for a maximum short-circuit current threshold. Beyond this threshold, the reactions are liable to damage certain axes or transmission means of the mechanism and to increase the tripping force at the level of the stage comprising the hook, the opening ratchet and the latching lock. Operation of the instantaneous circuit breaker requires a response time of about 10 ms to obtain tripping of the mechanism, which is too long, if the performances of the circuit breaker have to meet the requirements of high electrodynamic strength and a breaking capacity greater than 130 kA.

It has already been proposed to use the mechanical reaction arising from electro-dynamic compensation of the compensated contact means to bring about automatic tripping (see document EP-A-0,780,380). The opening ratchet comprises disengageable actuating means bringing about self-unlocking of the lock in the presence of a short-circuit current exceeding a calibration threshold defined by flexible means, said self-unlocking being commanded from a mechanical reaction generated by the electrodynamic compensation effect and causing ultrafast rotation of the lock to unlock the opening ratchet before the tripping part operates.

The circuit breaker obtained has very good performance as far as electrodynamic strength is concerned as self-unlocking is in practice calibrated for high current levels, notably greater than 180 kA peak. To obtain a sufficient breaking capacity, it is however necessary for the pole and its extinguishing chamber to have very large dimensions to the detriment of the general size and of the price.

SUMMARY OF THE INVENTION

The object of the invention is therefore to achieve a circuit breaker with a high electro-dynamic strength and a very high breaking capacity, requiring a reduced tripping force, and a short tripping time when a large short-circuit current occurs, these performances having to be able to be obtained in a small space and at low cost.

According to the invention, this problem is solved by means of a low voltage circuit breaker with high electrodynamic strength comprising: a frame, one or more poles comprising a pair of contact means comprising a movable contact means and another contact means, the movable contact means comprising a support carrier movable with respect to the frame between an open position and a closed position, and one or more contact fingers movable with respect to the support carrier between a contact position with the other contact means and a retracted position, each pole comprising in addition electromagnetic compensation means able to apply electromagnetic forces on the contact finger or fingers tending to keep the finger or fingers in contact with the other contact means, the circuit breaker comprising in addition an opening spring designed to be released from a loaded position to an unloaded position, a kinematic system operating in conjunction with the opening spring and with the pair of contact means in such a way that release of the opening spring drives the support carrier to its open position, this system comprising a kinematic connecting means for connection with the support carrier, an opening operating mechanism comprising an opening lock designed to take a locking position in which it prevents release of the opening spring and to release the opening spring by leaving its locking position, and actuating means operating in conjunction with the movable contact means and with the opening lock and able to cause ultrafast movement of the opening lock to its unlocked position when the resultant of the forces applied by the carrier on the kinematic connecting means exceeds a preset ultrafast opening threshold. The pole or poles comprise in addition electromagnetic limiting means designed to apply electromagnetic forces on the contact finger or fingers tending to drive the finger or fingers to their retracted position. The electromagnetic compensation means and the electromagnetic limiting means are such that when the current intensity flowing in the pair of contact means is less than a threshold called the limiting threshold, the finger or fingers are kept in contact with the other contact means, and that above said threshold, the finger or fingers are driven to their retracted position. Finally, the assembly is such that the resultant of the forces applied by the carrier to the kinematic connecting means when the current intensity flowing in the movable contact means reaches the limiting threshold is less than the ultrafast opening threshold. Separation of the contacts enables the intensity of the short-circuit current flowing in the pole to be limited during the time necessary for opening of the circuit by the actuating means. The circuit breaker thus enables much higher prospective currents than before to be broken. The limiting threshold enables the required high electromagnetic strength to be preserved. The actuating means for their part enable breaking to be confirmed within a very short time before the conventional trip device operates.

Preferably, the actuating means comprise flexible means defining said ultrafast opening threshold. Thus, operation of the actuating means when the ultrafast opening threshold is exceeded is not instantaneous. The spring in fact has to cover a certain travel before causing ultrafast opening of the opening lock. In other words, the electrodynamic forces have to provide a certain energy which corresponds to the mechanical compression work of the springs before the ultrafast opening order is transmitted. There is therefore a very short time delay before opening takes place. This time delay is particularly taken advantage of when the flexible means are calibrated in such a way that ultrafast opening takes place after the limited current intensity has reached its maximum value. Releasing of the opening lock therefore takes place after the maximum current has been exceeded, whereas the limited current flowing in the pole has started to decrease. The stresses on the end of travel stops of the opening mechanism are therefore reduced, which increases the reliability of the device.

Given the extremely high speed of the opening process, it is advantageous to integrate in the device means ensuring strong short-circuit current limiting in the retraction phase of the contact fingers. For this purpose the pole or poles comprise an arc extinguishing chamber and a magnetic circuit arranged in such a way as to generate a magnetic field according to the current flowing in the other contact means and directed in such a way as to generate forces on the electrical arc arising when separation of the contact means takes place tending to project the electrical arc towards the arc extinguishing chamber.

According to a preferred embodiment, the pole or poles comprise an arc extinguishing chamber and a magnetic circuit arranged in such a way as to generate a magnetic field according to the current flowing in the other contact means and directed in such a way as to generate forces on the electrical arc arising when separation of the contact means takes place tending to project the electrical arc to the arc extinguishing chamber. The short-circuit current is thus greatly limited.

BRIEF DESCRIPTION OF THE DRAWINGS

Other advantages and features of the invention will become more clearly apparent from the following description of an embodiment thereof, given as a non-restrictive example only and represented in the accompanying drawings in which.

DETAILED DESCRIPTION OF THE PREFERRED EMBODIMENT

Figure 1:
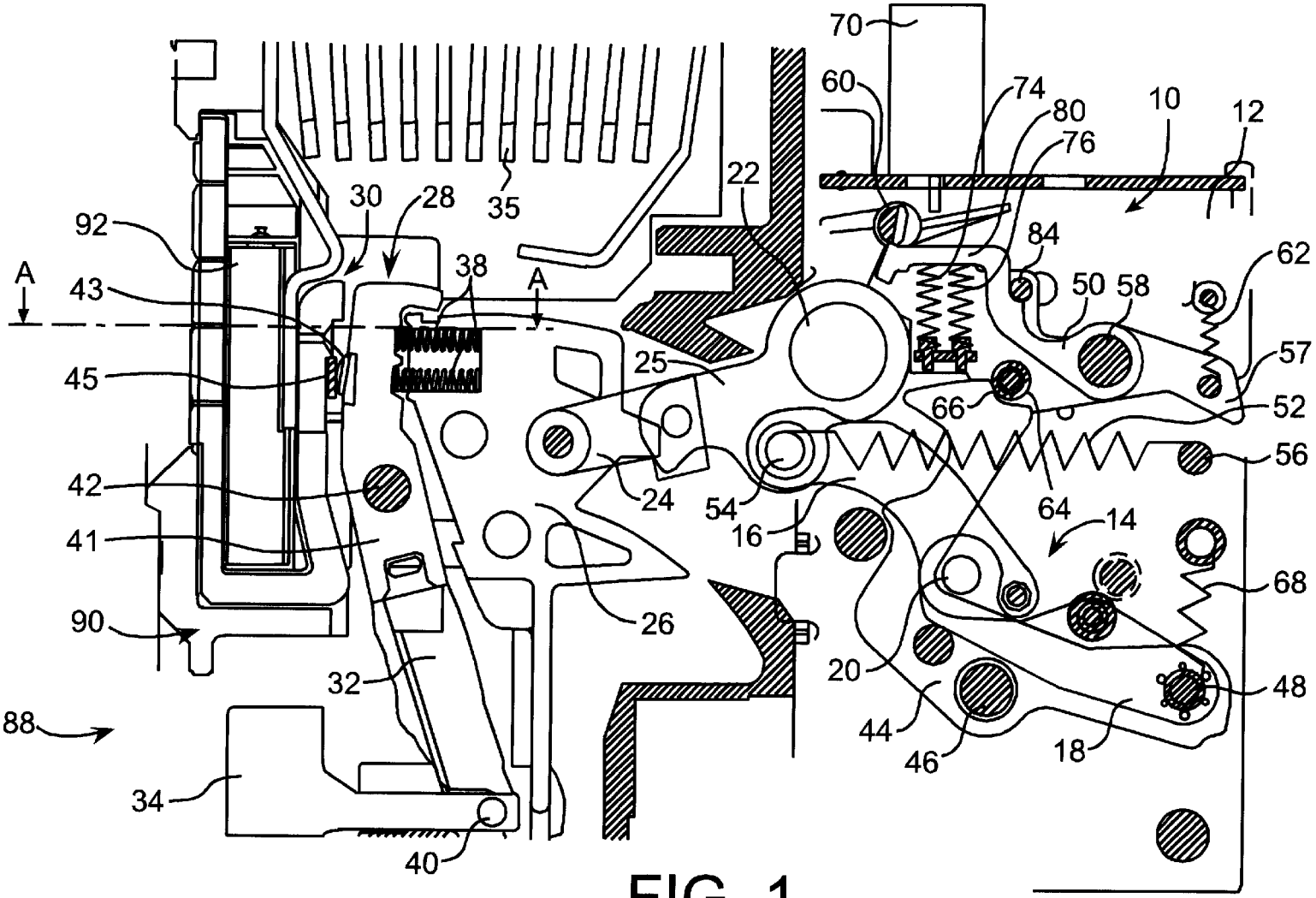
FIG. 1 is a schematic view of a pole of a circuit breaker according to the invention comprising an operating mechanism in the closed position and contact means in the contact position.

With reference to FIGS. 1 to 4, an operating mechanism of a multipole circuit breaker is supported by a frame 12 and comprises a toggle device 14 having a pair of transmission rods 16, 18 articulated on a pivoting axis 20. The lower rod 16 is mechanically coupled to a switching bar 22 made of insulating material extending perpendicularly to the flanges of the frame 12. The switching bar 22 is common to all the poles and is formed by a shaft mounted in rotation between an open position and a closed position of the circuit breaker contact means. The circuit breaker is of the high intensity type with a high electrodynamic strength.

At the level of each pole there is arranged a connecting rod 24 which connects a crank 25 of the bar 22 to an insulating carrier 26 of a movable contact means 28. The movable contact means 28 operates in conjunction with a stationary contact means 30, in the closed position, and is connected by a braid 32 to a first connection strip 34. The stationary contact means 30 is directly supported by the second connection strip 36. The pole comprises an arc extinguishing chamber 35 whose inlet is situated close to the contact means 28 and 30.

Figure 2:
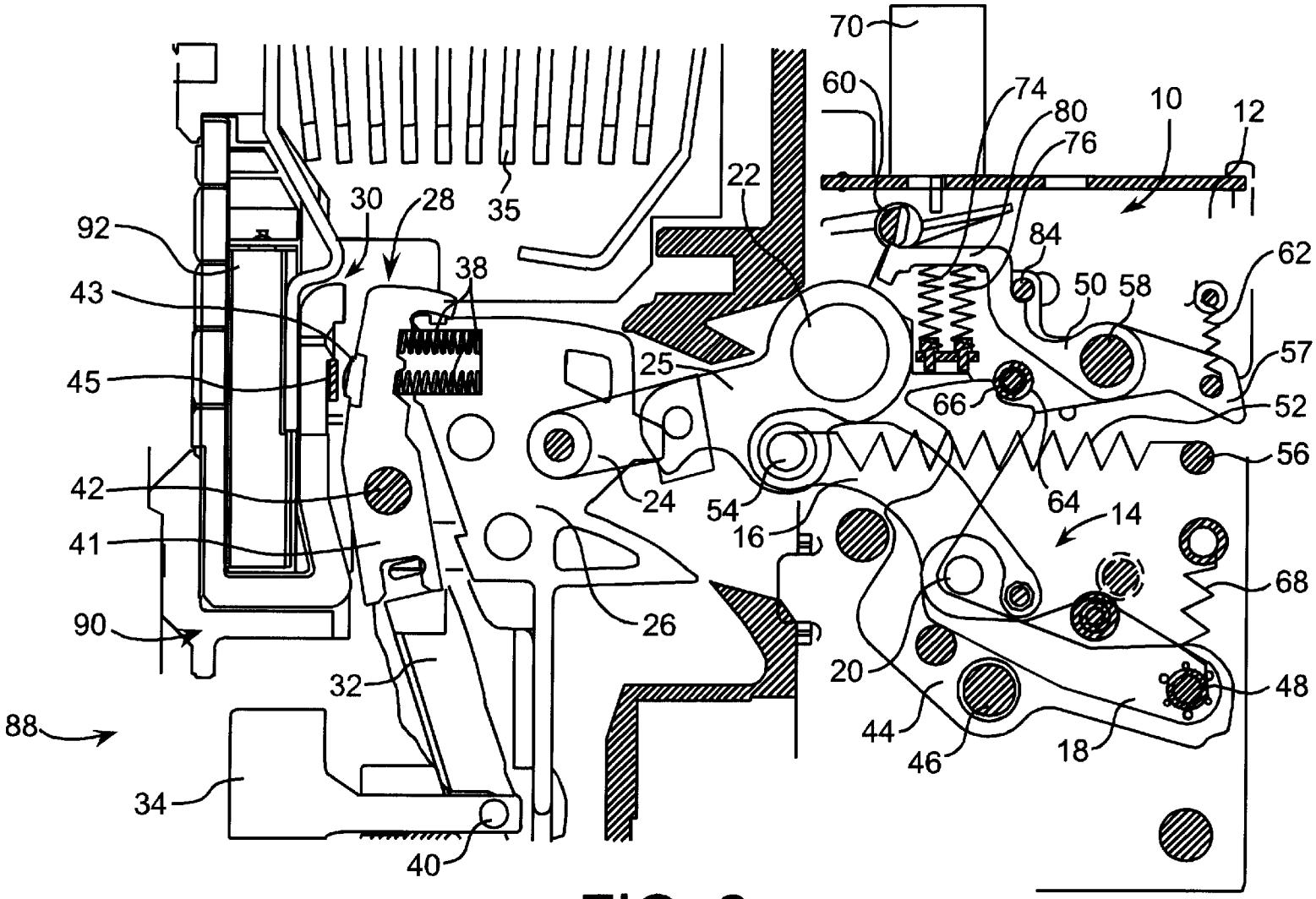
FIG. 2 is an identical view to FIG. 1 representing the mechanism in the closed position and the contact means in the retracted position.
Figure 3:
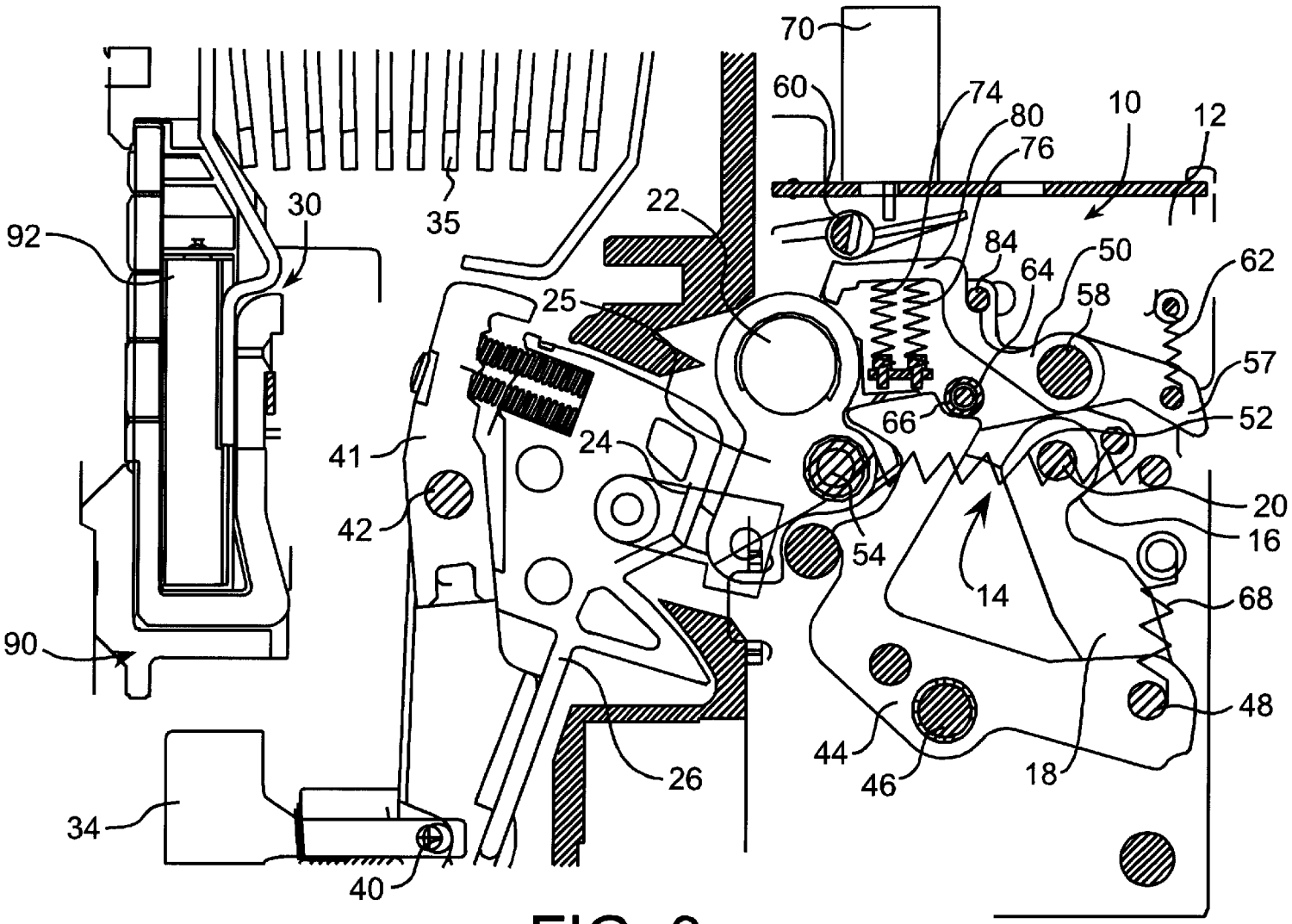
FIG. 3 is an identical view to FIG. 1 representing the mechanism in the open position.
Figure 4:
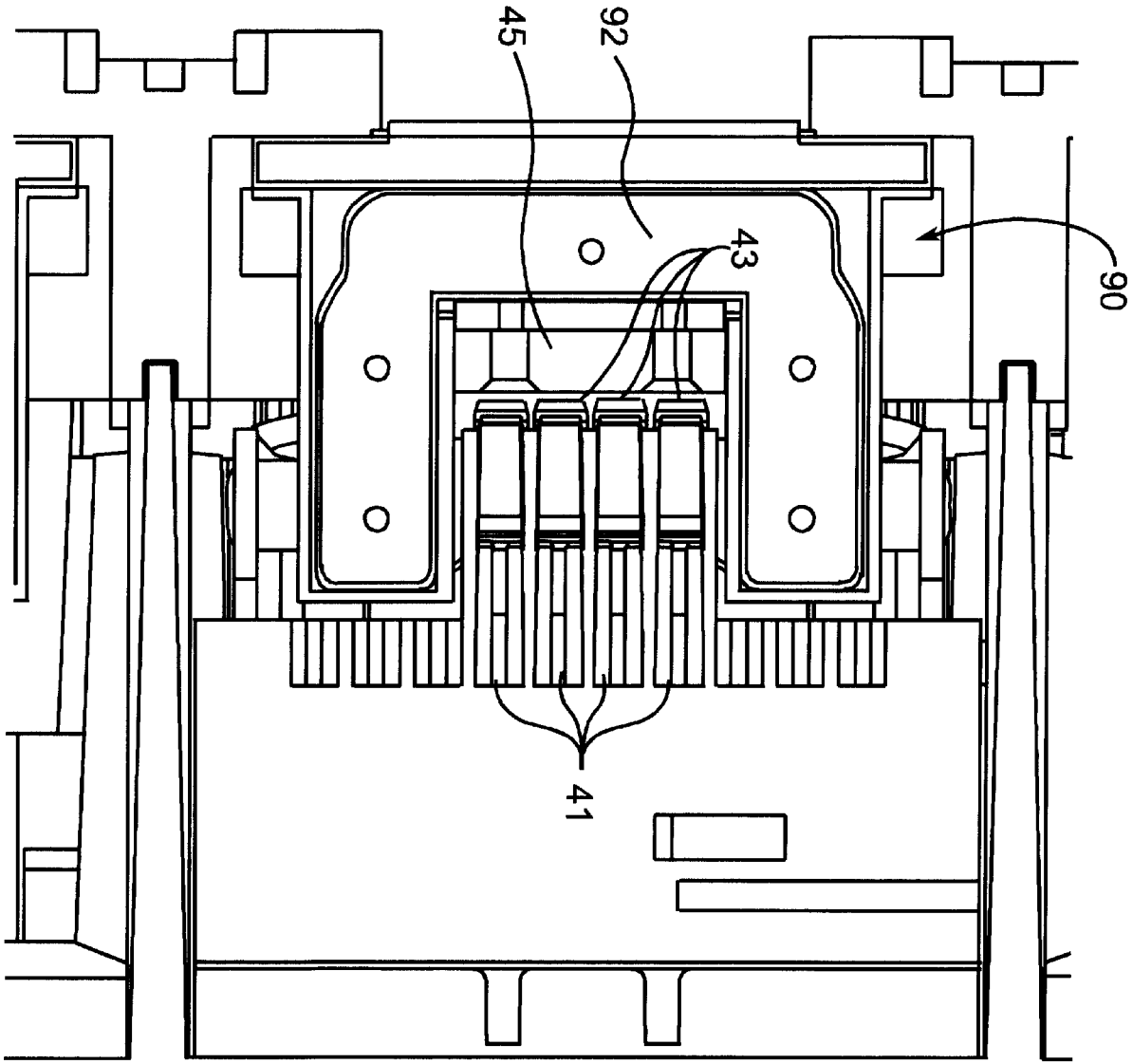
FIG. 4 is a cross sectional view in the plane A—A of FIG. 1.

The carrier 26 is pivotally mounted around a first axis 40 between the closed position of FIG. 1 and the open position of FIG. 3, and the movable contact means 28 comprises a plurality of parallel fingers 41 articulated on a second axis 42 of the carrier 26 between a contact position visible in FIG. 1 and a retracted position visible in FIG. 2. Each finger supports a contact pad 43 operating in conjunction with a contact pad 45 of the stationary contact means 30, in the position of FIG. 1. Contact pressure springs 38 are arranged between the carrier 26 and the upper face of the fingers 41.

The position of the longitudinal axis of the connecting rod 24 with respect to the axis of rotation 40 of the carrier 26 on the one hand and with respect to the pivoting axis of the switching bar 22 on the other hand is characteristic of a circuit breaker with high electrodynamic strength. Indeed, the large lever arm of the rod 24 with respect to the axis 40 and the small lever arm of the rod 24 with respect to the axis of the switching bar 26 ensure that the circuit breaker operating mechanism is not subjected to too high forces when strong repulsive forces induced by high intensity currents are applied to the contact fingers. A large part of the forces are in fact transmitted to the switching bar support bearings, whereas the torque applied by the rod 24 to the bar 22 remains moderate, which limits the stress on the other elements of the mechanism 10 linked to the bar 22.

There is associated to the toggle device 14 a tripping hook 44 mounted with limited rocking movement on a main axis 46 between a loaded position and a tripped position. The main axis 46 is secured to the frame 12 and one of the ends of the hook 44 is articulated on the upper transmission rod 18 by an axis 48, whereas the other opposite end operates in conjunction with an opening latch 50.

An opening spring 52 is secured between a pin 54 of the bar 22 and a fixed spigot 56 of the frame 12, said spigot 56 being located above the toggle device 14. The opening ratchet 50 is formed by a locking lever 57 pivotally mounted on an axis 58 between a locked position and an unlocked position. A latching lock 60 in the shape of a half-moon is designed to move the opening ratchet 50 to the unlocked position to bring about tripping of the mechanism 10.

A return spring 62 of the opening ratchet 50 is located opposite the latching lock 60 with respect to the axis 58 and urges the opening ratchet 50 counterclockwise to the locked position. A roller 64 is arranged on the locking lever 57 between the axis 58 and the latching lock 60 and operates in the loaded position in conjunction with a bearing surface 66 of the tripping hook 44. The bearing surface 66 of the hook 44 presents a recess in which the cylindrical roller 64 engages. A return spring 68 is secured between the axis 48 and the spigot 56 to urge the hook 44 counterclockwise to the loaded position, in which the roller 64 of the opening latch 50 is engaged in the recess of the bearing surface 66.

The latching lock 60 of the opening ratchet 50 is operated by a tripping device 70 to drive the locking lever 57 to the unlocked position, resulting in tripping of the mechanism 10 and opening of the contact means 28, 30. The tripping device 70 may be actuated manually, in particular by means of a pushbutton, or automatically, in particular by a magneto-thermal or electronic trip device, or by an energized release sensitive to a remote control signal.

Figure 5:
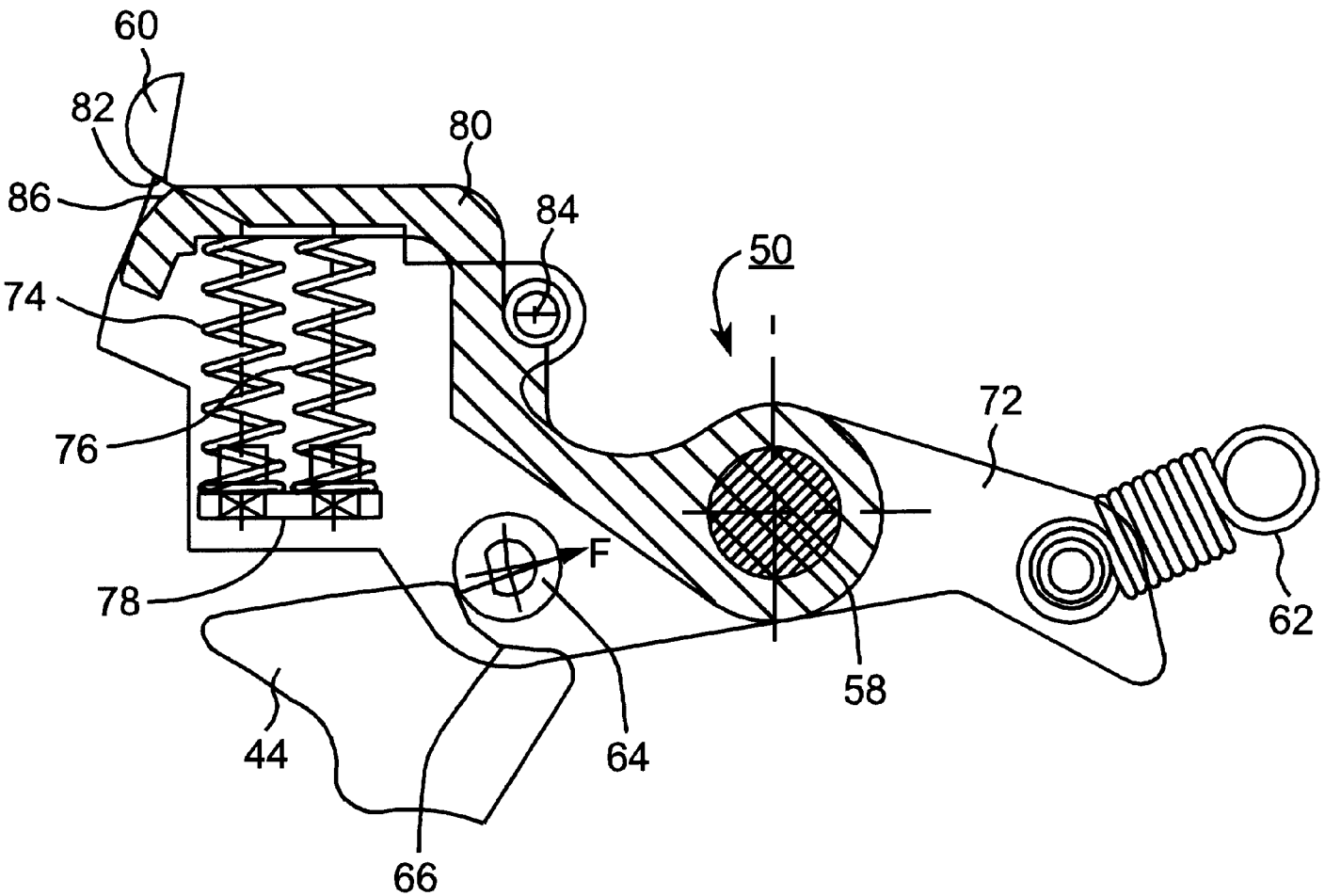
FIG. 5 shows a view of an opening ratchet of the circuit breaker of FIG. 1, in the locked position.
Figure 6:
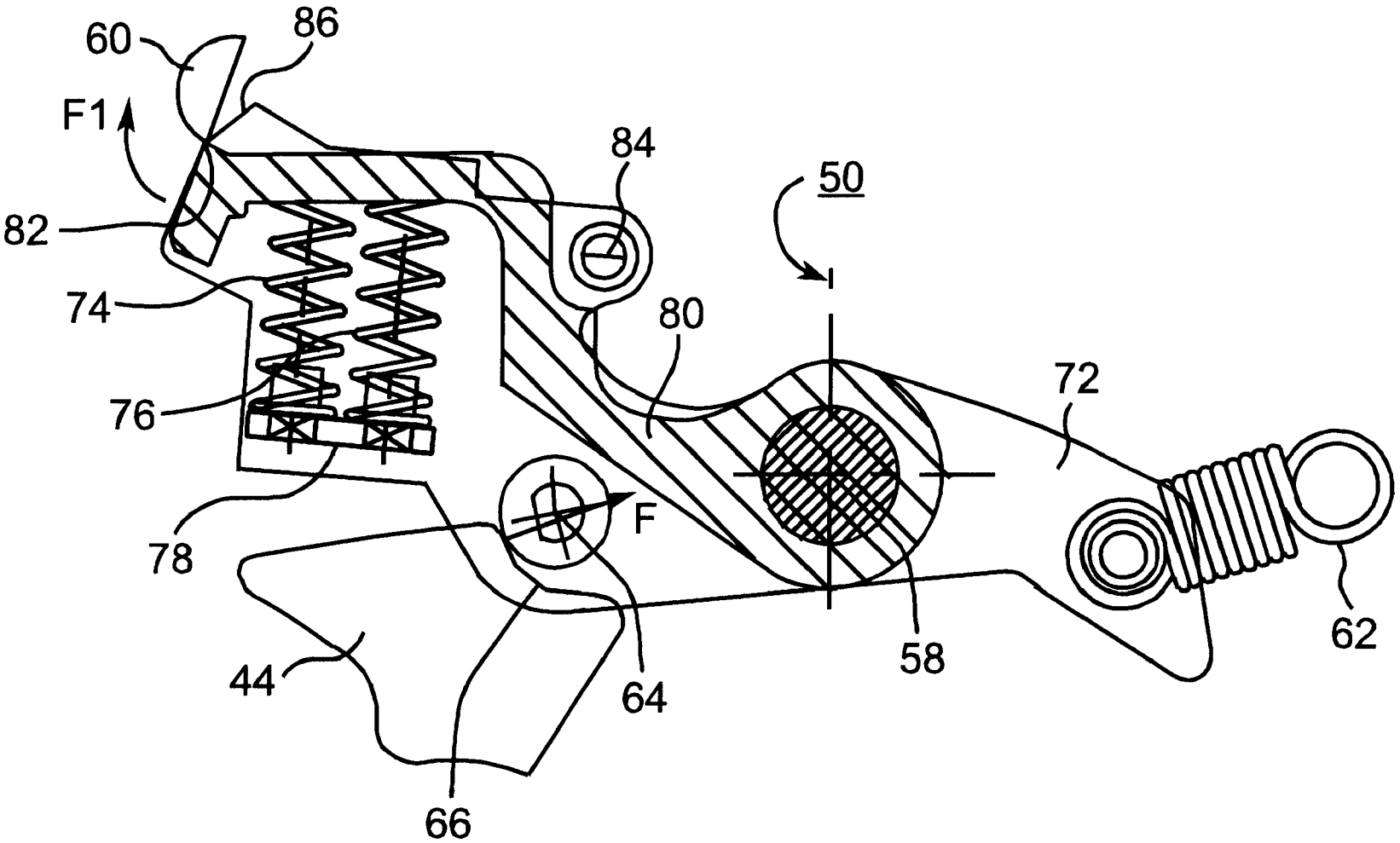
FIG. 6 is an identical view of the ratchet of FIG. 3 when the self-unlocking phase of the lock takes place.

With reference to FIGS. 5 and 6, the opening ratchet 50 comprises a pair of support flanges 72 of the axis 58 and of the roller 64 mounted with free rotation. The disengagement threshold is calibrated by means of two compression springs 74, 76 arranged between a guide plate 78 secured to the flanges 72 and a retaining lever 80 articulated on the axis 58. The end of the retaining lever 80 is provided with a nose 82 designed to latch on the lock 60 in the locked position of the ratchet 50.

An end of travel stop 84 is secured to the flanges 72 and is designed to limit the pivoting movement of the ratchet 50 in the unlocked position. Each flange 72 comprises an operating ramp 86 located near to the nose 82 of the retaining lever 80, the incline of the ramp 86 being chosen to cause self-unlocking of the lock 60 when the calibration threshold of the springs 74, 76 is exceeded.

The opening ratchet 50 is arranged as a disengageable assembly enabling self-unlocking of the lock 60 to take place in the presence of a short-circuit current exceeding a preset threshold hereinafter called disengagement threshold.

The contact means 28, 30 and the strips 34, 36 form a first U-shaped electrical circuit structure, the second articulation axis 42 of the movable contact fingers 28 being situated at one third of the distance separating the two strips 34, 36. The structure 88 of such a circuit constitutes a compensation system of the electrodynamic repulsion forces designed to keep the contact means closed in the presence of a short-circuit current.

The stationary contact means forms a second U-shaped circuit structure placed in such a way that its side branches point opposite the contact strip 34. The contact pad 45 is supported by one of the lugs of this U, on the side where its free end is located. In the closed position, the contact fingers 41 extend almost parallel to the lug of the U bearing the stationary contact pad 45. When a current is flowing through the pole, the electrical charges flowing in the U formed by the stationary contact means between the strip 36 and the contact pad 45 generate an induced electromagnetic field. In order to greatly increase the value of the induced field in the zone situated between the pads 43, 45 and the axis 42, a U-shaped magnetic plate is inserted in the U formed by the stationary contact means. The structure 90 of such a circuit constitutes a limiting system designed to separate the movable contact pads 43 from the stationary contact pads 45, in the presence of a short-circuit current exceeding a certain threshold fixed by the calibration of the contact pressure springs 38.

Operation of the limiting circuit breaker according to the invention is as follows:

In the closing phase of the mechanism 10, the bearing surface 66 of the tripping hook 44 exerts a force F on the roller 64 and urges the opening ratchet 50 in clockwise rotation around the axis 58 until the nose 82 latches with the lock 60. The circuit breaker is then in a stable closed position of the contact means 30, 28.

Figure 7:
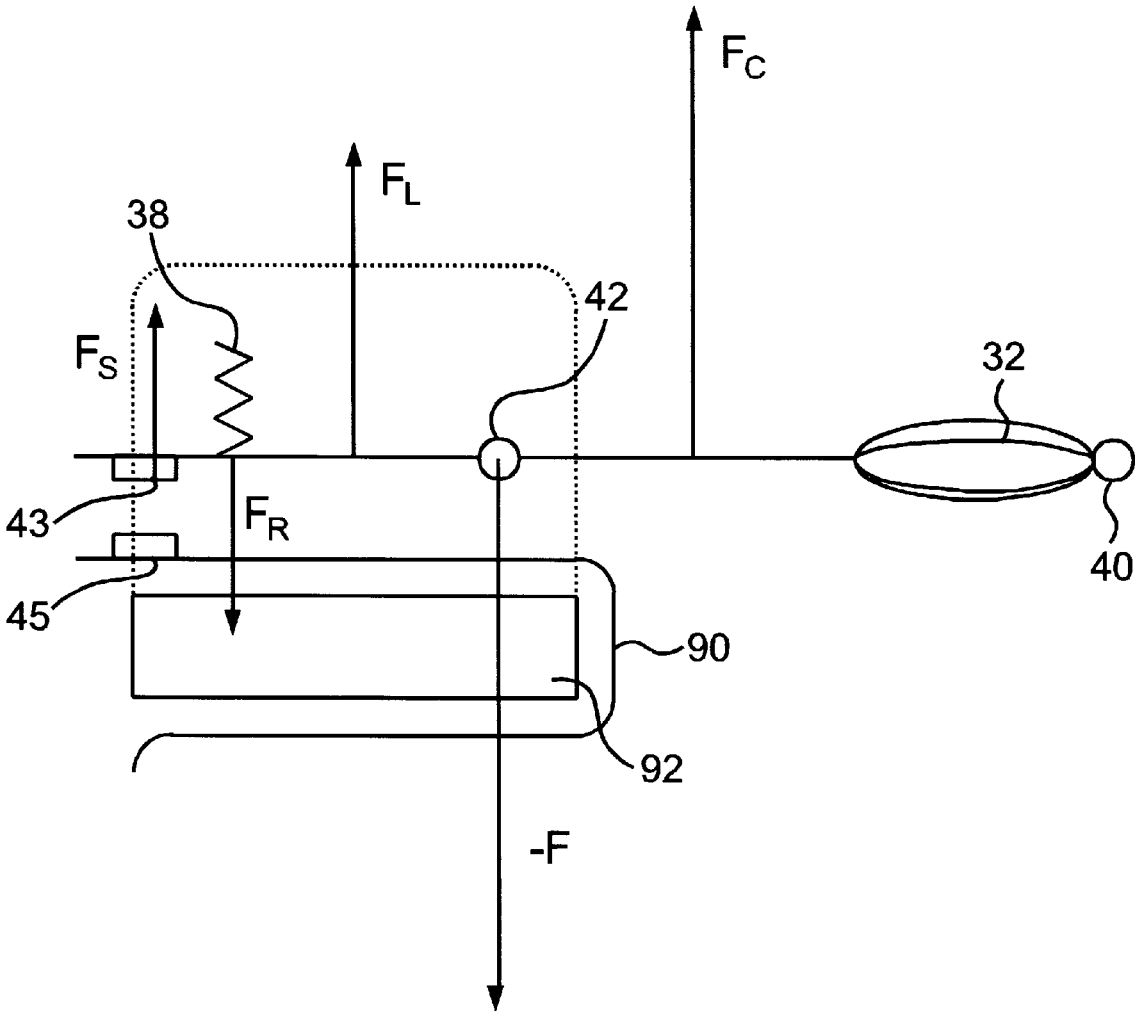
FIG. 7 represents schematically the forces applied on the contact means.

In the presence of a current flowing in the pole, the fingers are subjected to different forces represented schematically in FIG. 7. Firstly, the current flowing through the pads 43 generates repulsive striction forces $F_S$ at the level of the pads, the moment of which forces with respect to the pivoting axis 42 of the fingers 41 tends to lift the latter. Secondly, the second structure of the U-shaped circuit 90 also generates a moment tending to open the fingers 41. The electrical charges flowing in the contact fingers 41 are in fact subjected to electromagnetic forces due to the field induced by the charges flowing in the U formed by the stationary contact means 30 and concentrated by the magnetic U 92. These forces have a resultant $F_L$ whose application point is situated between the axis 42 and the pads 43, which tends to make the fingers pivot around the axis 42 in the direction of separation of the contact pads 43, 45. Thirdly, the contact pressure springs 38 exert on the fingers 41 a force $F_R$ independent from the current flowing in the circuit and whose moment with respect to the axis tends to move the movable pads 43 towards the stationary pad 45. Fourthly, the first U-shaped structure 88 also generates a moment tending to move the pads towards one another. The electrical charges flowing in the contact fingers 41 are in fact subjected to electromagnetic forces due to the field induced by the charges flowing in the U 88 formed by the two contact strips and the fingers. These forces are approximately uniformly distributed along the fingers 41 and have a resultant $F_C$ whose application point is therefore situated appreciably in the middle of the segment whose ends are formed by the pads 43 of the fingers 41 on the one hand and by the axis 40 on the other hand. The second articulation axis 42 of the fingers of the movable contact 28 being advantageously situated at one third of the distance separating the two connection strips 34, 36 of the first U-shaped structure, this results in a torque tending to move the pads 43, 45 towards one another.

For small overload currents, the sum of the moments generated by the contact pressure springs 38 and by the first U-shaped structure is greater than the sum of the moments generated by the striation forces on the pads 43 and by the second Ushaped structure 90. The pads 43, 45 are thus kept in contact. However, the sum of the moments generated by the contact pressure springs and by the first U-shaped structure increases less quickly with the current than the sum of the moments generated by the striction forces and by the second U-shaped structure. There therefore exists a value $I_L$ of the current intensity flowing in the pole, hereinafter called limiting threshold, beyond which the sum of the moments generated by the contact pressure springs and by the first U-shaped structure becomes smaller than the sum of the moments generated by the striction forces and by the second U-shaped structure.

When the current reached exceeds this threshold value $I_L$, the contact fingers 41 pivot around the axis 42 to the position of FIG. 2. The electromagnetic field concentrated by the magnetic U in the region of the pads of the contact means then enhances expulsion of the electrical arc to the arc extinguishing chamber, which fosters fast limitation of the current flowing in the pole.

In this phase, the electrodynamic forces generated by the two U-shaped circuit structures correspond to a mechanical reaction F exerted on the axis 42 of the carrier 26 and transmitted to the mechanism 10 and finally to the roller 64 by means of the tripping hook 44. This reaction F is a linear function of the sum of the moments, with respect to the pivoting axis 40 of the carrier, of the forces exerted on the carrier 26, and is therefore proportional to the sum of the modules $F_S+F_L+F_C$. The force F on the roller 64 is an increasing function of the intensity of the current flowing in the electrical power circuit. However, the force F corresponding to the threshold value of the intensity of the current flowing in the pole which causes pivoting of the fingers is insufficient to bring about a movement of the opening ratchet. The contact carrier therefore remains in the closed position.

If the current continues to increase in spite of the limiting effect obtained by separation of the pads, the electromagnetic forces on the carrier also continue to increase, and when the intensity of the current flowing in the pole reaches a second threshold value $I_C$ higher than the first value, the force F exceeds the calibration threshold of the ratchet 50, which is defined by springs 74, 76, and starts to make the opening ratchet 50 rotate clockwise.

At the beginning of the rotational movement of the opening ratchet, the nose 82 of the retaining lever 80 remains in engagement with the latching lock 60, but the flanges 72 of the ratchet 50 start to rotate clockwise around the axis 58. From a calibrated force corresponding to the self-unlocking threshold of the latching lock 60, the ramps 86 of the flanges 72 of the ratchet 50 cooperate with the half-moon of the lock 60 and cause rotation thereof in the clockwise direction F1, in such a way as to release the retaining nose 82, resulting in movement of the opening ratchet to the unlocked position (FIG. 6). Releasing of the roller 64 also releases the tripping hook 44, which causes opening of the contact means 30, 28 by the opening spring 52 associated to the toggle device 14.

Tripping of the mechanism 10 by the disengagement effect of the opening ratchet 50 is ultrafast and takes place before operation of the tripping device 70, which has a response time which depends on the type of magnetothermal or electronic trip device used in the circuit breaker. The presence of the opening ratchet 50 with self-disengagement of the latching lock 60 enables the circuit breaker to be mechanically self-protected in ultrafast manner while remaining compatible with instantaneous protection of the trip device.

The springs 74, 76 are calibrated in such a way that the threshold lc is about 110% of $I_L$. Ultrafast self-unlocking of the mechanism 10 takes place for a high current level, notably greater than 100 kA. The circuit breaker therefore remains essentially a selective circuit breaker with high electrodynamic strength. Its limiting character is only sensitive above 90% of its selectivity threshold. It is this limiting character which gives it an excellent breaking capacity.

The relatively small variation of the current intensity between $I_L$ and $I_C$ corresponds to a large variation of the force F since the three components $F_S$, $F_L$ and $F_C$ are all three increasing functions of the current. It is therefore easy to adjust the springs 74, 76 to obtain the required calibration and eliminate any risk of triggering self-unlocking before the limiting threshold.

Figure 8A:
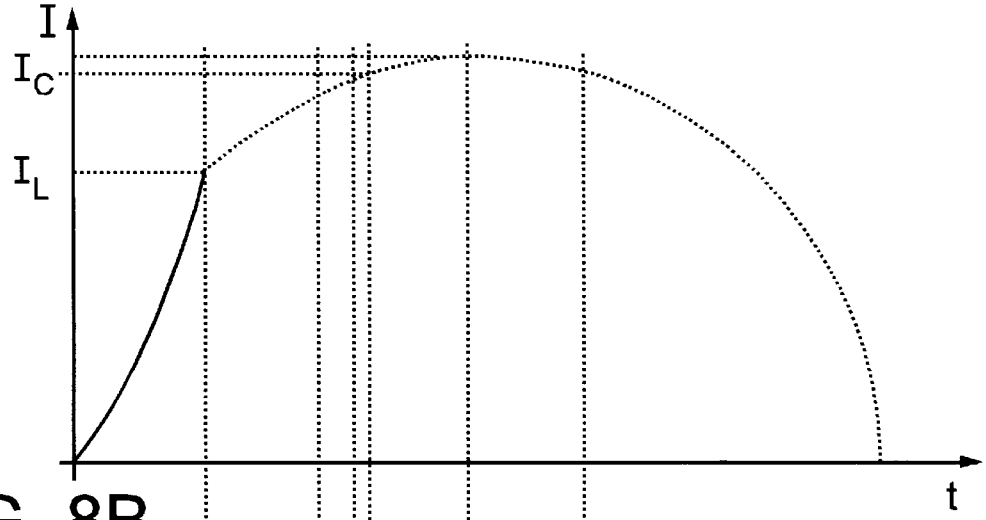
FIG. 8 represents the variation in time of the current 1, the voltage U and the distance X of the contact means measured between a movable pad and a stationary pad of these means when opening takes place on a short-circuit.
Figure 8B:
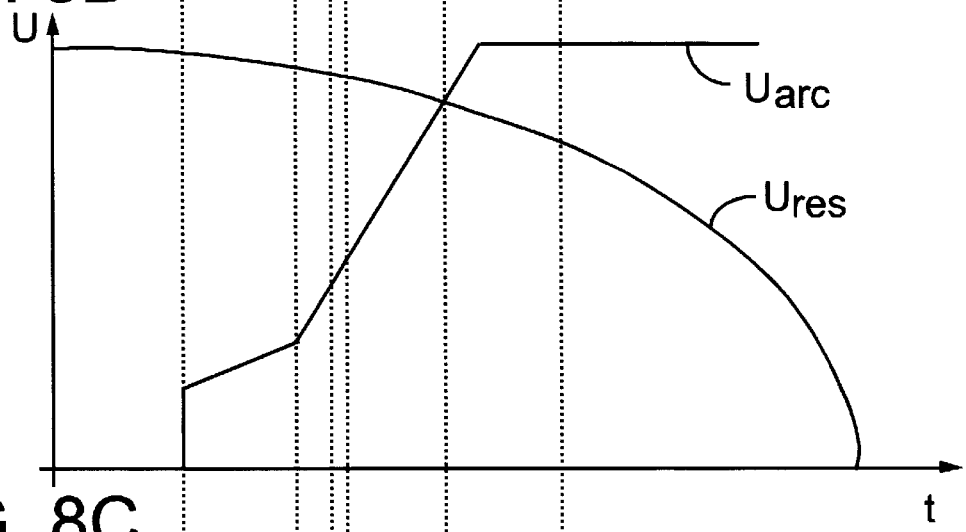
Figure 8C:
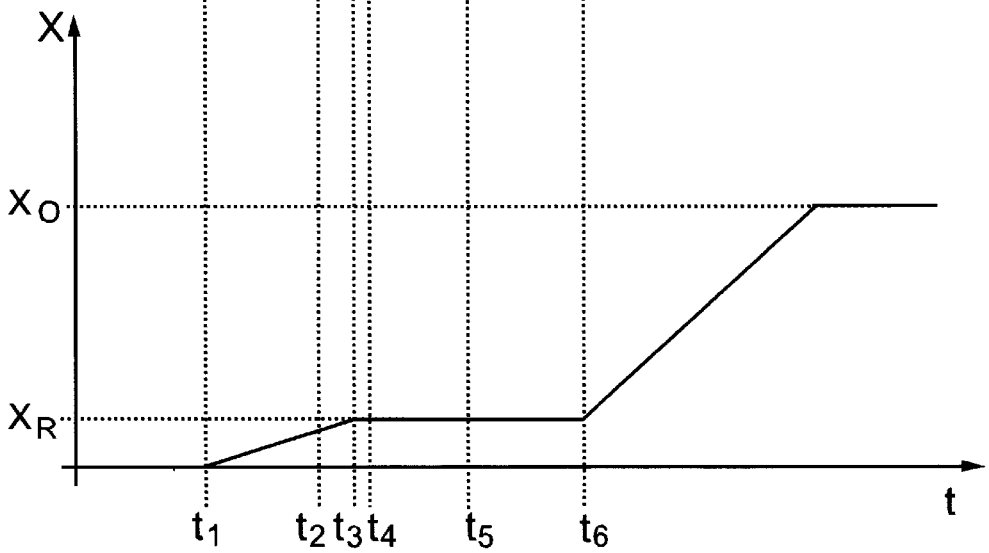

As an illustrative example, an example of the chronological sequence of opening in the presence of a short-circuit current has been reproduced in FIG. 8. At the time $t_1$, the current $I_L$ is flowing in the pole the contact fingers start separating and an arcing voltage $U_{arc}$ appears, which increases as a first approximation with the distance X separating the contact pads. At the time $t_2$, the contact fingers are sufficiently far apart and the arc sufficiently large for the magnetic U to project the arc into the chamber. From this time on, the arcing voltage increases more quickly. The contact fingers continue their repulsion travel and reach their maximum repulsion position $X_R$ of FIG. 3 at $t_3$. At $t_4$, the current reaches a value $I_C$ which triggers movement of the opening ratchet. However, the distance between contact pads does not vary before the mechanical work necessary for compression of the springs 74, 76 has been delivered. Opening of the operating mechanism by release of the opening latch 60 only takes place at a time after $t_4$. In the meantime, between $t_4$ and $t_6$, the arcing voltage continues to increase by expansion in the extinguishing chamber until it reaches the power system voltage, at the time $t_5$, and then exceeds this voltage. At $t_5$, the limited current intensity is at its maximum. Opening of the operating mechanism 10 at $t_6$ therefore takes place in a current intensity decrease phase, which ensures a relatively slow opening which spares the end of travel stops of the movable elements of the mechanism 10. At the end of opening, the movable pads 43 reach their position of FIG. 3, at the distance $X_0$ from the stationary pad.

According to the embodiments of FIGS. 1 to 6, the relative movement between the flanges 72 and the retaining lever 80 of the opening ratchet 50 is achieved by a rotational movement having a small angular incidence. It is clear that this relative movement can be obtained by a translational movement by means of an oblong aperture.

For the sake the simplification, the description of the above example has been made with reference to the forces developed in a single pole. However, when the circuit breaker is a multipole circuit breaker, the force F applied on the rollers depends on the stresses on all of the poles.

We claim:

1. A low voltage circuit breaker with high electrodynamic strength comprising:

a frame one or more poles comprising a pair of contact means comprising a movable contact means and another contact means, the movable contact means comprising a support carrier movable with respect to the frame between an open position and a closed position, and one or more contact fingers movable with respect to the support carrier between a contact position with the other contact means and a retracted position electromagnetic compensation means able to apply electromagnetic forces on the contact finger or fingers tending to keep the finger or fingers in contact with the other contact means, an opening spring designed to be released from a loaded position to an unloaded position, a kinematic system operating in conjunction with the opening spring and with the pair of contact means in such a way that release of the opening spring drives the support carrier to its open position, this system comprising a kinematic connecting means for connection with the support carrier, an opening operating mechanism comprising an opening lock designed to take a locking position in which it prevents release of the opening spring and to release the opening spring by leaving its locking position, actuating means operating in conjunction with the movable contact means and with the opening lock and able to cause ultrafast movement of the opening lock to its unlocked position when the resultant of the forces applied by the carrier on the kinematic connecting means exceeds a preset ultrafast opening threshold, wherein:

the pole or poles comprise in addition electromagnetic limiting means designed to apply electromagnetic forces on the contact finger or fingers tending to drive the finger or fingers to their retracted position, the electromagnetic compensation means and the electromagnetic limiting means are such that when the current intensity flowing in the pair of contact means is less than a threshold called the limiting threshold, the finger or fingers are kept in contact with the other contact means, and that above said threshold, the finger or fingers are driven to their retracted position, and the resultant of the forces applied by the carrier to the kinematic connecting means when the current intensity flowing in the movable contact means reaches the limiting threshold is less than the ultrafast opening threshold.

2. The circuit breaker according to claim 1, wherein the actuating means comprise flexible means defining said ultrafast opening threshold.

3. The circuit breaker according to claim 2, wherein the flexible means are calibrated in such a way that ultrafast opening takes place after the limited current intensity has reached its maximum value.

4. The circuit breaker according to claim 1, wherein the pole or poles comprise an arc extinguishing chamber and a magnetic circuit arranged in such a way as to generate a magnetic field according to the current flowing in the other contact means and directed in such a way as to generate forces on the electrical arc arising when separation of the contact means takes place tending to project the electrical arc to the arc extinguishing chamber.

5. The circuit breaker according to claim 1, wherein the support carrier is movable in rotation around a fixed axis with respect to the frame, and the contact finger or fingers pivot around an axis linked to the support carrier and are returned to the contact position by one or more return springs operating in conjunction with the carrier.

* * * * *